US006312783B1

(12) United States Patent
Radwan

(10) Patent No.: US 6,312,783 B1
(45) Date of Patent: Nov. 6, 2001

(54) POLYPROPYLENE-BASED CARPET YARN

(75) Inventor: Amin Radwan, Dalton, GA (US)

(73) Assignee: Oriental Weavers of America, Dalton, GA (US)

( * ) Notice: Subject to any disclaimer, the term of this patent is extended or adjusted under 35 U.S.C. 154(b) by 0 days.

(21) Appl. No.: 09/709,306

(22) Filed: Nov. 13, 2000

(51) Int. Cl.[7] ..... D01F 6/00; D01F 8/00

(52) U.S. Cl. ..... 428/97; 428/364; 428/373; 8/483; 264/210.8; 264/78; 264/210.6

(58) Field of Search ..... 428/373, 97, 364; 264/210.8, 210.6, 78; 8/483

(56) References Cited

U.S. PATENT DOCUMENTS

| | | | |
|---|---|---|---|
| 3,182,105 | 5/1965 | Bonvicini et al. . | |
| 3,651,028 | 3/1972 | Maemoto et al. . | |
| 3,659,009 | 4/1972 | Fuest et al. . | |
| 3,820,949 | 6/1974 | Johnson | 8/21 B |
| 3,926,553 | 12/1975 | Fuest | 8/169 |
| 5,186,879 | 2/1993 | Simons et al. | 264/211.15 |
| 5,576,366 | 11/1996 | Sheth | 524/140 |
| 5,985,999 | 11/1999 | Dominguez et al. | 524/74 |
| 6,046,279 | 4/2000 | Roberts et al. | 525/285 |
| 6,132,839 * | 10/2000 | Reader | 428/97 |

* cited by examiner

*Primary Examiner*—N. Edwards

(57) ABSTRACT

Compounding and extruding a composition, comprising 60–95 weight-% polypropylene, 0.1–10 weight-% maleated polypropylene, and 5–40 weight-% nylon or polyester, through a spinneret at a temperature in the range of 235–285° C., and drawing the resulting filament. Drawing is carried out at a draw ratio substantially lower than the draw ratio that would be necessary to obtain the same elongation with 100% polypropylene. Color pigments may be included in the composition which is compounded and extruded. In accordance with this invention, high proportions of polypropylene may be blended with nylon or polyester without detracting substantially from the good touch and luster attributable to the latter polymers. Also disclosed are carpeting and rugs in which the pile is made up of filaments produced by a process of this invention. In the manufacture of such carpeting or rugs, individual filaments can be dyed and then assembled into a rug, or the composite material can be manufactured and then the composite material piece can be dyed.

12 Claims, 2 Drawing Sheets

POLYPROPYLENE-BASED CARPET YARN

FIELD OF THE INVENTION

The present invention relates to the manufacture of colored polymeric filaments that are especially useful in the construction of carpeting. The polymeric filaments of the present invention are blends of polypropylene with nylon or polyester. Solid or multi-color filaments (nylon or polyester is compounded with polypropylene) by using MB; alternatively, dyeable filaments (nylon or polyester is compounded with polypropylene) to produce solid colors or space dyes.

BACKGROUND OF THE INVENTION

In the field of carpets, nylon filament is generally preferred for the pile because of its look (luster), feel (silky), and dryability. In some applications, the look and soft feel of polyester filament is desirable. However, nylon and polyester are relatively expensive.

An object of the present invention is to provide blends of nylon or polyester that will be significantly less expensive than pure nylon or polyester yet will retain, in large part, desirable attributes attributable to the nylon and polyester resins.

SUMMARY OF THE INVENTION

The present invention bonds two dissimilar materials together that otherwise would have poor adhesion to each other. These two materials are polypropylene on the one hand and nylon or polyester on the other hand. In accordance with the present invention, they are bonded together with maleated polypropylene.

The process of the present invention involves compounding and extruding a composition, comprising 60–95 weight-% polypropylene, 0.1–10 weight-% maleated polypropylene, and 5–40 weight-% nylon or polyester, through a spinneret at a temperature in the range of 235–285° C., and drawing the resulting filament. Drawing is carried out at a draw ratio substantially lower than the draw ratio that would be necessary to obtain the same elongation with 100% polypropylene. The terminology "substantially lower" in this case means at least 10% lower. Drawing in the present invention is carried out in order to obtain filaments having a denier in the range 2–35/filament.

In accordance with the present invention, color pigments may be included in the composition which is compounded and extruded. For instance, nylon or polyester may be compounded in a masterbatch with polypropylene, maleated polypropylene, and pigment in a conventional extruder through different feeding hoppers, or two or more of these materials may be compounded or mixed together in a first step and added to the remaining components in a second step to provide the same final product. The masterbatch may also contain such conventional additives as $TiO_2$, UV stabilizers, and/or antioxidants. These additives can be added direct to the extruder. If more than one extruder is used, multicolor yarn can be obtained. Using this approach, high proportions of polypropylene may be blended with nylon or polyester without detracting substantially from the good touch and luster attributable to the latter polymers.

Alternatively, the process of the present invention may make use of the additional step of acid or dispersion dying to provide space dyed yarn. Even with this approach, some pigment may be added to the masterbatch in order to provide a dyeable filament having a color closer to the desired final color than the resins themselves would have. As in the case described above, nylon may be compounded in a masterbatch with polypropylene, maleated polypropylene, and pigment in a conventional extruder through different feeding hoppers, or two or more of these materials may be compounded or mixed together in a first step and added to the remaining components in a second step to provide the same final product. The masterbatch here too may also contain such conventional additives as $Tio_2$, UV stabilizers, and/or antioxidants. However, with this approach, a preferred additive is a liquid dye enhancer. This increases the dyeing sites in the nylon by about 0.5%, thus permitting the use of less nylon in the blend. The liquid dye enhancer is not washed out of the filament during processing. The product can be dyed with disperse dye or with acid dye, depending on the relative amount of nylon in the blend, the darkness of the target color, and the intended application. This approach can be accomplished in conventional extruders, without the necessity for side extruders or special spinnerets such as those used in the manufacture of sheath-core type bicomponent filament yarns.

The present invention also contemplates carpeting and rugs in which the pile is made up of filaments produced by any process of this invention. In the manufacture of such carpeting or rugs, individual filaments can be dyed and then assembled into a rug, or the composite material can be manufactured and then the composite material piece can be dyed. In accordance with the latter technique, piece dyeing occurs when the composite material is contacted as a unit with the dyeing medium. An example of piece dyeing is the immersion of carpeting (backing and pile) in a bath of dye.

DETAILED DESCRIPTION OF THE INVENTION

Figure 1:
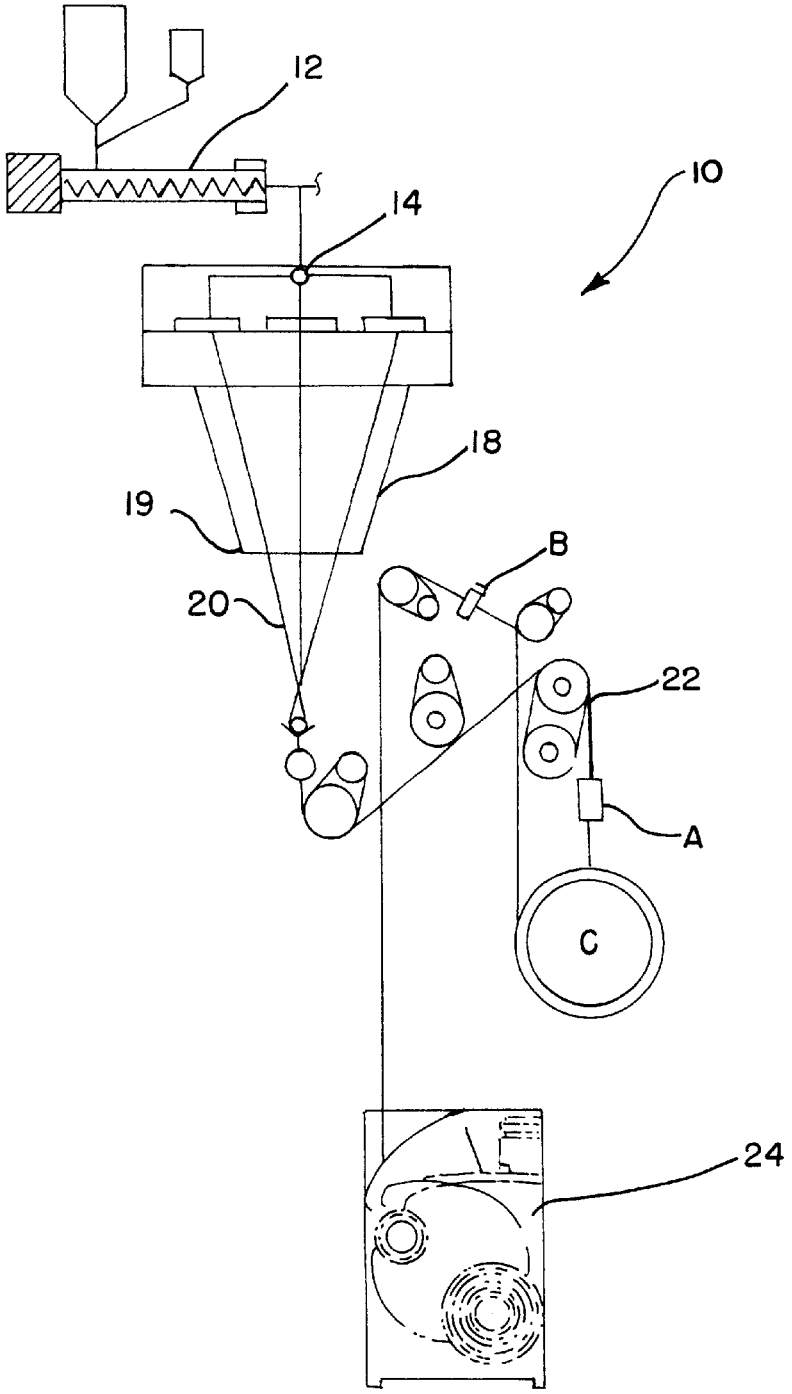
FIG. 1 presents a schematic elevational view of a spinning process in accordance with the present invention.

Polypropylene-based resins are readily adaptable to spinning into filaments. Although polypropylene resin can be satisfactorily spun into a filament, the polypropylene must generally then be colored in order to produce commercially marketable composite materials such as carpeting and rugs. One approach to obtaining colored carpets is to compound the polypropylene resin blend that will be used to make a carpet with a pigment before it is spun. The other approach is to dye the polypropylene blend filaments after they are spun. However, this is difficult because standard polypropylene is unsuitable for dyeing. Therefore manufacturers generally use nylon to make yarns that are suitable for dyeing. The present invention takes these two normally incompatible materials—nylon and polypropylene—and combines them together with a small amount of maleated polypropylene which acts as an adhesive, thus providing a blended filament which has desirable characteristics derived from both materials.

Preparing the Filaments

The filaments of the strands extruded according to the present invention are based upon polypropylene resins. In addition to the polypropylene, they contain substantial proportions of additional resins selected from the group consisting of nylon resins and polyester resins.

Suitable nylon-type polyamides which may be blended therewith include, but are not limited to: nylon 6, nylon 6/6, nylon 6/10, nylon 11, nylon 12, copolymers thereof, and mixtures thereof. The preferred nylon is nylon 6.

Alternatively, polyester resins—such as the condensation product of a terephthalic acid, isophthalic acid, naphthalene dicarboxylic acid, succinic acid, adipic acid, or the like, with an ethylene glycol, 1,3-propanediol, neopentyl glycol, 1,4-cyclohexanedimethanol, or the like—may be blended with the polypropylene base resin. Preferred polyesters include polyethylene terephthalate, polybutylene terephthalate, and polyethyleneterephthalate cross-linked with pentaerithritol.

In order to promote adhesion between the polypropylene resin and the nylon or polyester resin, a maleated polypropylene is added to the blend. U.S. Pat. No. 6,046,279 discloses blends of nylon with polypropylene and maleated polypropylene, although not in the context of filaments useful for the manufacture of carpeting and rugs. The entire disclosure of this patent is expressly incorporated herein by reference.

Various other conventional additives may be included in the blend prior to processing it, including lubricants, antioxidants, ultraviolet light stabilizers, pigments, dyes, antistatic agents, soil resists, stain resists, antimicrobial agents, and flame retardants.

Those skilled in the art will recognize that processing parameters, such as temperatures, draw ratios, and so on, will vary according to the precise nature of the resin blend being spun. The individual filaments may be of any cross-sectional shape, including round, multilobal, hollow, etc.

Luster can be controlled by varying the amount of $TiO_2$ added. Luster can also be controlled by adjusting the spinneret hole shape. The feel, or hand, of the yarn can be modified by changing the dpf (that is, denier per filament), or by increasing the nylon or polyester content.

One advantage of the present invention is that it permits the manufacture of carpets that weigh less than comparable carpets made with 100% nylon pile. For the same pile height, carpet weight is directly proportional to specific gravity. A comparison of the specific gravities of several compositional embodiments that may be used in the present invention with the specific gravity of nylon follows:

| Composition | Specific Gravity |
|---|---|
| 100% Nylon | 1.14 |
| 88% PP, 2% MPP, 10% Nylon | 0.925 |
| 76% PP, 4% MPP, 20% Nylon | 0.95 |
| 64% PP, 6% MPP, 30% Nylon | 0.975 |
| 52% PP, 8% MPP, 40% Nylon | 1.00 |

Spinning, Drawing

The present invention includes continuous filaments (CF) technology, bulked continuous filament (BCF) technology, and crimping fibers methods (staple fibers). CF or BCF yarn can be used directly from the extruder. As those skilled in the art will appreciate, it can be twisted and heat-set. Staple fibers can be used in the manufacture of needle punch carpets or can be spun into carpet yarn, separately or mixed with other fibers of this invention.

Preferably, each fiber strand will have a total denier between about 300 and 6000 and a denier per filament between about 2 and 30, such as is typically found in yarns made for tufting into carpet. More preferably, the strand will have a total denier between about 400 and 1400 and a denier per filament between about 3 and 28. The strands may have a different number of filaments per strand (filament count) or total strand denier to create desired effects in the final yarn product. Thus, for example, the larger the individual strand, the more propensity for that strand to become vivid in the yarn.

Following extrusion, the filaments are quenched. A finish suitable for the type of filament (e.g., polypropylene/maleated polypropylene/nylon 6, or polypropylene/polyester) may be applied using a number of finish applicators corresponding to the number of strands.

The strands are guided separately, possibly using a grooved roller, to and from the draw rolls. The groups are drawn in side-by-side fashion at a draw ratio suitable for the type of filament. A series of guide pins, e.g. made of ceramic, may also be used. The pins are preferably grooved to help stabilize the components and prevent them from jumping together before passing a texturing jet. Drawing preferably includes passing each feed yarn over heated draw rolls paired with grooved separator rolls where the separator rolls have at least one grooved path for each strand to keep them separate during drawing. The drawing step of the present invention can be accomplished using a draw ratio determined for the type of filament being made. When the yarn is polypropylene/maleated polypropylene/nylon 6, the draw ratio is preferably about 2.2 to 3.

FIG. 1. FIG. 1 illustrates a spinning apparatus 10. A conventional extruder 12 for melting polymer chip is in fluid communication with a conventional spinning beam 14. Within spinning beam 14, there is a conventional spinning pack 16. Pack 16 may be of an annular design; it filters the polymer by passing the polymer through a bed of finely divided particles, as is well known in the art. Included as part of the pack 16 is a conventional spinneret (not shown). flow rates of polymers through the pack may range from about 10 to 100 pounds per hour. The upper limit of 100 pounds is defined only by the physical dimension of the pack 16, and greater flow rates may be obtained by the use of larger packs. The spun denier per filament (dpf) ranges from 3 to 30. Optimum properties and mechanical qualities for the yarn appear between 4 and 15 dpf.

The filament as it leaves the spinneret may optionally be quenched with a cold inert gas, such as air. Typically the gas is at about 20° C. and is provided at about six standard cubic feet per minute. If the air is too hot, e.g. over 45° C., the spun yarn properties are significantly deteriorated.

Immediately below and snugly (that is, airtightly) mounted to spinning beam 14 is an elongated column 18 after spin cabinet. The column comprises an insulated tube having a length of about 2 meters or greater. The internal diameter of the tube is sufficiently large (e.g., 12 inches) so that all filaments form the spinneret may pass the length of the tube without obstruction.

Inside the bottom-most end of the column 18 is a perforated, truncated cone 19, which acts as a means for reducing air turbulence. The cone 19, preferably three feet in length and having a diameter co-extensive with the tube diameter at its uppermost end and a diameter of about one half that at the bottom end, is used to exhaust air, via a valved exhaust port 21, from the bottom-most end of the tube so that movement in the thread line, due to air turbulence, is substantially reduced or eliminated completely.

Inside the bottom-most end of the column 18 is a perforated, truncated cone 19, which acts as a means for reducing air turbulence.

Below the bottom-most end of the column, the thread line is converged. This convergence may be accomplished by a finish applicator 20. This is the first contact the yarn encounters after leaving the spinneret.

Following a first application of the finish at the finish applicator 20, the yarn is taken around a pair of godet rolls 22. The first finish application may be made to reduce static electricity built up on the filaments. However, as this finish is sometimes thrown off when the filaments pass over the godet rolls, the finish may be reapplied after the godet rolls.

In the case of BCF, after drawing, the yarn passes through a texturing box (A) where hot air pressure is applied, then to a cooling drum (C), then through an entanglement box (B), and finally onto a conventional tension control winder 24. The wind up speed is typically greater than 3000 mpm (9800 fpm), with a maximum speed of 5800 mpm (19000 fpm). The optimum range is between about 1000 mpm (3280 fpm) and 3800 mpm (12400 fpm).

Figure 2:
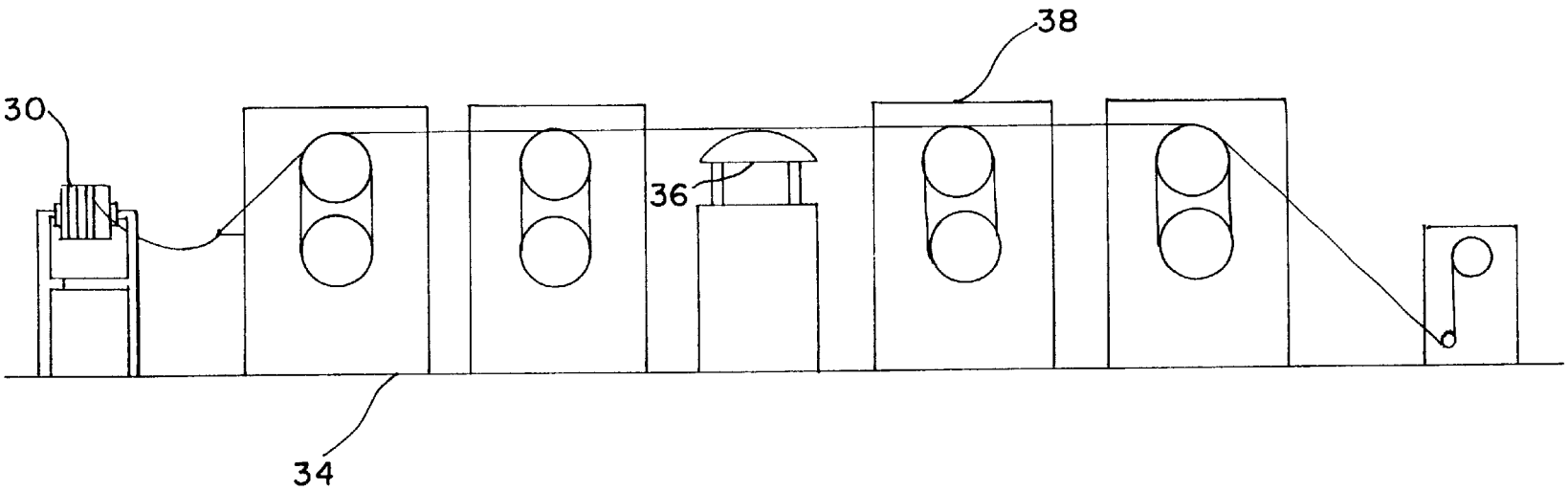
FIG. 2 presents a schematic elevational view of a drawing process in accordance with the present invention.

FIG. 2. Referring to FIG. 2, the spun yarn is thereafter drawn. Either a one stage or two stage drawing operation may be employed. However, a second stage offers little additional benefit. Often the drawing operation will e coupled directly to the spinning operation, providing a spin/draw process.

The as-spun yarn may be fed from a creel 30 onto a feed roll 34 that may be heated from ambient temperatures up to about 150° C. Thereafter, the filament is fed onto a draw roll 38 which may be heated from ambient temperatures up to approximately 155° C. If heated rolls are not available, a hot plate 36, which may be heated from 120–145° C., may be used. The hot plate 36 (having a 6-inch curved contact surface) is placed in the draw zone, that is, between feed roll 34 and draw roll 38. The draw speed ranges from 75 to 300 meters per minute. The typical draw ratio is about 1.65 for spun yarn made at about 3800 meters per minute. The optimum fee roll temperature, giving the highest tensile strength, is about 90° C. The optimum draw roll or hotplate temperature is about 145° C. The draw roll temperature gives some control over hot air shrinkage, with lower draw roll temperatures resulting in higher drawn yarn shrinkages.

Similar results can be obtained in the case of staple fibers. However, instead of the creel, a spinning area (extrusion, spin pump, spinnerets, quench air, etc.) is employed. The cable of filaments is treated beginning from the feed roll 34, passing through a spin finish oil applicator and texturing unit, then to the cutter, and finally to the pallet press.

Coloring the Filaments/Dyeing the Carpeting or Rugs

The filaments may be colored in the melt according to any conventional process for doing so. Melt coloration is also called solution dying. Differences in color or colorability can be accomplished by conventional methods of providing differential dyeability, such as by making one feed yarn from regular anionic dye-dyeable nylon and the other yarn from cationic dye-dyeable nylon, according to methods well known to those skilled in the art.

The composite material can be piece dyed according to this invention in any manner that result in the dyeing of the entire composite material or a large portion thereof at substantially the same time. As examples, the entire composite material can be immersed in a bath of the dye, or the dye can be padded on, or can be sprayed on, or the like. Additionally large portions, such as rolls of the carpet, can be dyed continuously by immersion in a bath prior to being place on rolls.

The dye useful in this invention can comprise any dye known to dye the particular polymeric composition selected and contacted with a suitable dye reception promoter. This invention is particularly suited for use with disperse dyes. Examples of dyes that are commercially available for use in this invention are Foron Blue ER (MFG), C.I. Disperse Blue 73 or Terasil Blue GL (MFG), Polydye Red BC (MFG), and the like. Wetting agents and pH adjusters can also be added to the selected dye to produce optimum dyeing characteristics.

According to this invention, the dyeing conditions generally can comprise any conditions that result in dyeing the composite material. Specifically, the concentration of dye can comprise any concentration that will result in differentially dyeing the composite material. The range of concentrations can vary from about 0.1 to about 2.0 weight % based upon the weight of the filament, or even higher or lower. Also one or more colors with different shades can be used, to make space dye yarn having a fixed repeat of the color shade, with repetition from 1 inch to over 5 feet.

According to this invention, the time used for piece dyeing can comprise any time that will result in dyeing the composite material. Generally, the range from about 10 to about 100 minutes is satisfactory, although shorter and longer time periods are possible.

The temperature of the dyeing medium during the dyeing process can comprise any temperature that will result in differentially dyeing the composite material. Generally, the temperatures can range from about 50° C. to about 150° C., although higher or lower temperatures are also within the scope of this invention.

EXAMPLES

The following non-limiting Examples illustrate various aspects of the present invention.

Example 1

Solid Colored Yarn, Pile Carpeting or Rugs 84 pounds of commercially available polypropylene pellets (MFI 18–30) are melted in a reactor with 2 pounds of commercial available maleated polypropylene, 10 pounds of commercially available nylon 6, and 4 pounds of red color MB (which comprises for example 25% $TiO_2$ and is polypropylene or polyethylene or nylon based). The melted materials are flowed into a conventional extruder equipped with conventional spinnerets and a conventional spin pump. The extruder is heated to 250° C. and a filament is extruded and is drawn utilizing conventional godets. The draw ratio between the slow godet and the fast godet, however, is 15% lower than that which would normally be used with 100% polypropylene in order to obtain the same elongation. The viscosity of this mixture is 8400 CPAs (method 02983) and the yarn has a tenacity of 2.15, a breaking load of 14, an elongation of 65.5%, and a total specific gravity of 0.925.

The yarn produced by this process was used to provide the pile in a carpet. The color of the pile was observed to be a fully homogenous red, without any streaking. The cost of this red yarn is approximately 45% lower than the cost of a comparable 100% nylon yarn.

In an alternative embodiment, the red color MB, maleated polypropylene, and nylon are blended in a first step and the polypropylene is added to the blend in a second step.

Example 2

Dyed Yarn, Pile Carpeting or Rugs 62 pounds of commercially available polypropylene pellets are melted in a reactor with 6 pounds of commercial available maleated polypropylene, 30 pounds of commercially available nylon 6, and 1.5 pounds of yellow MB. ½ pound of liquid dye enhancer is injected via a dosing pump at the throat of a conventional extruder equipped with conventional spinnerets and a conventional spin pump. The extruder is heated to 250° C. and a filament is extruded and is drawn utilizing conventional godets. The draw ratio between the slow godet and the fast godet, however, is 20% lower than that which would normally be used with 100% polypropylene in order to obtain the same elongation. Subsequent to this production of the yarn, the yarn was dyed in a yellow disperse dye bath with three different shades.

The yarn produced by this process was used to provide the pile in a rug. The rug was woven with 315,000 knots/$m^2$, an 11.5 mm pile height, 8 colors, and a weight of 3 kg/$m^2$. The yellow color of the pile was observed to be fully homogenous to each shade, so that one can observe different shades repeated by the same period (space dye). The cost of this yarn is approximately 35% lower than the cost of a comparable 100% nylon yarn.

Example 3

Multicolored Tufted Carpet

Four solid color polymer blend streams are separately fed into a 4-extruder spin pack and are extruded in uniformly proportioned strands of 34 filaments each. Each polymer stream contains 84 wt-% polypropylene/2 wt-% maleated polypropylene/10 wt-% nylon 6/4 wt-% coloring agent. The colors are fawn, cedar, natural canvas, and black, respectively. Each block occupies one fourth of a rectangular spinneret's area. The extruded filaments are quenched before finish is applied separately to the strands. The strands are combined into yarn on draw rolls, drawn at a draw ratio of 2.7, and then textured using a single texturing jet. Finally, the yarn is air-interlaced before take up on a winder at 1650 meters per minute. The 2500 denier/136 filament yarn is ready for tufting or weaving.

Carpet construction yielding a roll of tenth gauge, ⅜' height, level loop or cut, 18 ounces/square yard carpeting is carried out by conventional procedures.

Example 4

Solid or Dyeable Polyester Yarn

For solid color, 84 wt-% polypropylene, 10 wt-% polyester, 4 wt-% maleated polypropylene, 1.5 wt-% coloring agent, and 0.5 wt-% UV stabilizer are all melted in an extruder operating at 285° C. and with a 250 hole spinneret. Using a drawing ratio of 2.5 and a winder speed of 2200 mpm, a polyester blend colored yarn costing 40% less than a comparable 100% polyester colored yarn is obtained. This polyester blend colored yarn can be used directly as CF or BCF, or it may be twisted and heat set. A similar, but space dyed, yarn can also be produced. The polyester blend colored yarn can be employed, using a conventional side weaving, single shot technique, to make carpeting having 535,500 knots/$m^2$, a pile height of 12 mm, and a weight of 3.75 kg/$m^2$.

The present invention may be embodied in specific forms alternative to those disclosed above without departing from the spirit or essential attributes thereof. The scope of the invention patented is accordingly to be delineated only with reference to the appended claims.

What is claimed is:

1. A process for preparing filament or yarn which comprises compounding and extruding a composition comprising 60–95 weight-% polypropylene, 0.1–10 weight-% maleated polypropylene, and 5–40 weight-% nylon or polyester through a spinneret at a temperature in the range of 235–285° C. and drawing the resulting filament.

2. The process of claim 1, wherein drawing is carried out at a draw ratio substantially lower than the draw ratio necessary to obtain the same elongation with 100% polypropylene to obtain filament having a denier in the range 2–35/filament.

3. The process of claim 1, wherein color pigments are included in the composition which is compounded and extruded.

4. The process of claim 3, wherein color pigments are compounded with nylon, polypropylene, and maleated polypropylene to form a blend which is extruded.

5. The process of claim 3, wherein color pigments are mixed with polyester and maleated polypropylene in a first step and added to polypropylene in a second step to form a blend which is extruded.

6. The process of claim 1, which comprises the further step of acid or dispersion dying to provide space dyed yarn.

7. Carpeting or a rug in which a pile comprises filaments produced by the process of claim 1.

8. Carpeting or a rug in which the pile comprises filaments produced by the process of claim 2.

9. Carpeting or a rug in which the pile comprises filaments produced by the process of claim 3.

10. Carpeting or a rug in which the pile comprises filaments produced by the process of claim 4.

11. Carpeting or a rug in which the pile comprises filaments produced by the process of claim 5.

12. Carpeting or a rug in which the pile comprises filaments produced by the process of claim 6.

* * * * *